US006688422B2

(12) United States Patent
Fuesser et al.

(10) Patent No.: US 6,688,422 B2
(45) Date of Patent: Feb. 10, 2004

(54) METHOD AND APPARATUS FOR ACTIVELY INFLUENCING THE INTAKE NOISE OF AN INTERNAL COMBUSTION ENGINE

(75) Inventors: Rolf Fuesser, Bad Herrenalb (DE); Franc Pricken, Freiberg (DE); Rolf Schirmacher, Germering (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 10/120,846

(22) Filed: Apr. 12, 2002

(65) Prior Publication Data

US 2002/0164038 A1 Nov. 7, 2002

Related U.S. Application Data

(63) Continuation of application No. PCT/EP00/08775, filed on Sep. 8, 2000.

(30) Foreign Application Priority Data

Oct. 15, 1999 (DE) ..... 199 49 685

(51) Int. Cl.[7] ..... F01N 1/06

(52) U.S. Cl. ..... 181/206; 381/71.5; 381/71.13; 381/71.9; 381/71.4; 381/71.14

(58) Field of Search ..... 181/206, 214; 381/71.2, 71.5, 71.8, 71.13, 71.9, 71.4, 71.14, 86

(56) References Cited

U.S. PATENT DOCUMENTS 5,063,598 A * 11/1991 Geddes ..... 381/71.5
5,097,923 A * 3/1992 Ziegler et al. ..... 181/206
5,229,556 A * 7/1993 Geddes ..... 181/206
5,321,759 A 6/1994 Yuan
5,386,372 A * 1/1995 Kobayashi et al. ..... 700/280
5,386,472 A * 1/1995 Pfaff et al. ..... 381/71.12
5,850,458 A * 12/1998 Tomisawa et al. ..... 381/71.4
6,120,012 A * 9/2000 Shibata et al. ..... 267/140.14

FOREIGN PATENT DOCUMENTS

FR 2692709 12/1993
JP 05098928 A * 4/1993 ..... F01N/1/06
JP 06058127 A * 3/1994 ..... F01N/1/00

OTHER PUBLICATIONS

"Adjusting the Tonal Quality of Engine Noise Using Active Noise Control Techniques", Research Disclosure, GB, Industrial Opportunities Ltd., Dec. 1990, pp. 972–973.

* cited by examiner

*Primary Examiner*—Robert Nappi
*Assistant Examiner*—Edgardo San Martin
(74) *Attorney, Agent, or Firm*—Crowell & Moring LLP

(57) ABSTRACT

A method and apparatus for actively influencing the intake noise of an internal combustion engine. The apparatus comprises a controller (7) which senses the actual noise (I) via a microphone (16) and compares the actual noise with a reference noise signal which depends on the engine speed D and at least one further engine parameter P, such as, for example, the throttle (12) position. A comparison signal V generated by comparing the actual noise to the reference noise value is used to adjust a control signal $A_{sum}$, which also depends on the engine speed D. The control signal is fed to an electromechanical transducer (14) which generates a correcting noise (20) which is superimposed on the intake noise (21) to produce the resultant actual noise (22), which should correspond as closely as possible to the reference noise value. The invention makes it possible to reduce the intake noise or to tailor the intake noise to a desired sound within the limits of the electromechanical transducer output so that, for example, a driver can be given an acoustic feedback under specified operating conditions.

7 Claims, 1 Drawing Sheet

METHOD AND APPARATUS FOR ACTIVELY INFLUENCING THE INTAKE NOISE OF AN INTERNAL COMBUSTION ENGINE

CROSS REFERENCE TO RELATED APPLICATIONS

This application is a continuation of international patent application No. PCT/EP00/08775, filed Sep. 8, 2000, designating the United States of America, the entire disclosure of which is incorporated herein by reference. Priority is claimed based on Federal Republic of Germany patent application no. DE 199 49 685.4, filed Oct. 15, 1999.

BACKGROUND OF THE INVENTION

The present invention relates to a method for actively influencing the intake noise of an internal combustion engine, wherein a correcting noise is generated which is superimposed on the intake noise. The invention also relates to an apparatus especially adapted to carry out the method of the invention.

The process of actively influencing the intake noise of an internal combustion engine, such as with a loudspeaker, is known. A possible circuit arrangement with a corresponding electrical process is illustrated in U.S. Pat. No. 5,321,759. The only feature of the arrangement of FIG. 1 of this document which is relevant in the present context is the intake tract 12, which emits an intake noise 20. The control system receives at least one engine speed signal 44 from the internal combustion engine 10, which is processed in the electronic control system 26. Additional variables, such as the position 18 of a throttle valve 16, can also be incorporated into the computing process of the electronic control system.

Using these measured variables, the control system 26 calculates an output signal, which is converted by a loudspeaker 28 into a sound, which is superimposed on the intake noise. The purpose of this measure is to reduce the intake noise. This purpose is achieved by taking advantage of the fact that a broad spectrum of the intake noise emanating from the internal combustion engine is directly dependent on the engine speed, while the frequency of the noise is based on various multiples of the engine speed. By emission of the noise determined in the intake tract by the control system through the loudspeaker 28, the corresponding partial noise in the intake tube can be reduced. In the ideal case, therefore, the noise emitted by the loudspeaker 28 requires an opposite and equal amplitude, so as to cancel the corresponding noise component.

To be able to measure the degree of noise reduction, an error microphone 30 is installed in the intake tract which absorbs the intake noise affected by the loudspeaker 28. The correspondingly filtered signal of the error microphone 30 provides the control system with information on the degree of noise reduction in the intake tract, so that the output signal for the loudspeaker 28 can be varied in terms of optimized noise reduction.

The system described above can be used to achieve effective reduction of the intake noise irrespective of the engine speed of the internal combustion engine. In comparison to conventional silencers, such as resonators, no additional volume is needed for active noise minimization. However, effective noise minimization using the method described above is not considered desirable in all operating states of an internal combustion engine. In certain operating states, the driver needs the acoustic information coming from the internal combustion engine for such purposes as to select the correct point at which to change gears during engine operation. Consequently, a consistent minimization of the intake noise across the entire engine speed range of the internal combustion engine would provide the driver with an inaccurate picture of engine characteristics, resulting in improper loading of the internal combustion engine and therefore in increased fuel consumption.

Furthermore, the publication "Adjusting the Tonal Quality of Engine Noise Using Active Noise Control Techniques" (XP 000163374 ISSN:0374–4353) discloses a method for actively influencing the intake noise of an internal combustion engine. This method makes it possible to tailor the intake noise which remains after noise cancellation to a reference noise. In this way the intake noise can be transformed either into a more powerful sound or also into a very quiet noise. For this purpose an LMS (leased mean squares) adaptive filter is utilized which generates a starting signal phase shifted by 180° in order to damp the intake noise. This starting signal is transformed into an analog signal which can be used to activate a loudspeaker arranged in the intake system. The acoustic waves generated by the loudspeaker are superimposed on the intake noise of the internal combustion engine, so that a cancellation is achieved. A microphone collects the instantaneous noise which remains after the cancellation and generates a corresponding feedback signal.

The filter input signal x(n) is read from a table depending on the angular position of the crankshaft. The values stored in the table list the harmonic oscillations of the intake noise which are to be canceled. These have the following form:

$$x(n)=A\sin(aq)+B\sin(bq)+C\sin(cq)+\ldots$$

wherein

A,B,C, . . . are the relative magnitudes;

a,b,c, . . . are the generated oscillations; and q is the angular position of the crankshaft.

To achieve a targeted adjustment of the intake noise of the internal combustion engine, a second generated signal d(n) is required, which is based on the angle of the crankshaft. This second signal forms the reference noise, which should remain after noise cancellation. The values for the reference noise have the following form:

$$d(n)=A'\sin(a'q)+B'\sin(b'q)+C'\sin(c'q)+\ldots$$

wherein

A', B', C' . . . are the desired relative magnitudes;

a', b', c' . . . are the desired oscillations or vibrations; and q is the angle of the crankshaft.

The error signal e(n), which is utilized to correct the coefficients of the LMS-adaptive filter, is generated by subtraction of the feedback signal of the microphone from the reference signal of the reference noise d(n). In this way the signal y(n) emitted from the LMS adaptive filter will assure that the intake noise emitted by the internal combustion engine will be matched or tailored to the reference noise. The reference noise can be maintained over the entire speed range of the internal combustion engine. Inlet or outlet noise vibrations, which are not created by the internal combustion engine, are generated by the active noise control system only depending on the angular position of the crankshaft.

In the described system a constant tailored adaptation of the reference noise depending on the angular position of the crankshaft is achieved. This tailored adaptation has the result that the reference noise is based exclusively on the crankshaft and other influences are not taken into account.

One could deactivate active noise minimization in certain operating states. However, this would result in an abrupt change in the intake noise, which would similarly confuse the driver, as he is not accustomed to such changes in conventional internal combustion engines. Consequently, the problem described above cannot be satisfactorily solved in this manner.

SUMMARY OF THE INVENTION

Therefore, it is the object of the invention to provide a method and/or apparatus for carrying out this method which makes possible better matching or tailoring of the intake noise.

This and other objects are achieved by the method of the invention as described and claimed hereinafter, as well as by the apparatus for carrying out the method, which apparatus is also described and claimed hereinafter.

In the method of the invention, an electromechanical converter or transducer which may, for example, comprise a loudspeaker which generates a correcting noise, is provided in a manner known in the art. This converter is installed in such a way that a correcting noise generated by the transducer can be superimposed on the intake noise. This can, for example, be achieved by securing the loudspeaker to the outside wall of the intake tract so that it emits sound into the interior of the intake duct. However, it is also possible to install the loudspeaker outside the intake system in the engine space. The key element here is that the sound waves emitted by the loudspeaker can be superimposed on the intake noise.

In addition, a sensor, especially a microphone, is provided which is installed in the engine space or in the intake tract in such a way that it can register the actual noise resulting from superimposition of the correcting noise from the electromagnetic converter on intake noise of the internal combustion engine. Both the electromechanical converter and the sensor are connected to the control system which, furthermore, processes at least one engine speed signal stemming from the internal combustion engine. The frequency, amplitude and phase of the output signal which drives the electromechanical converter are modified in dependence on the engine speed signal and the signal from the sensor.

The engine speed signal can be generated by a sensor provided specifically for this purpose and connected to the control system. Alternatively, it is also possible to obtain the engine speed signal from another information circuit provided in the internal combustion engine. Modern internal combustion engines feature an engine management system which also ensures utilization of the engine speed signal. This system can be utilized to obtain the engine speed information, thus eliminating the need for an additional engine speed sensor.

The electromechanical converter can be constructed in the form of a suitably dimensioned loudspeaker. If the overall system is skillfully designed, this can, for example, be a commercially available loudspeaker with a 15 cm diameter which is secured to the raw air line. The control sensor can be a simple electret microphone, which is especially effective if it is installed in proximity to the intake opening of the intake system. The electronic control system preferably comprises a signal processor system in which the functional units of the control system are digitally replicated. This allows for a very small, integrated and cost-effective construction of the system. Of course, the signal process system can also be accomplished with an analog computer circuit.

According to the invention, the method provides that the actual noise, which results from the superimposition of the correcting noise on the intake noise, is compared with a reference noise. It should be emphasized that the purpose of the reference noise is to achieve a desired noise at the intake tract of the internal combustion engine, meaning that it can also differ from zero. By comparing the actual noise with the reference noise, the control system can modify the characteristics of the correcting noise so that it approximates the desired reference noise when it is superimposed on the intake noise of the internal combustion engine. These approximation steps are constantly repeated, or the intake noise is even continuously adjusted additionally to conform to the reference noise.

This means that the desired reference noise must somehow be made available to the control system. It can, in particular, be determined in dependence on the engine speed of the internal combustion engine. This is advantageous because, for the reasons discussed earlier, the intake noise is also primarily dependent on the engine speed. This enables an intake noise to be generated as an actual noise. The objective can be to reduce the intake noise or, in certain cases, to increase the intake noise. Whether a reduction or an increase is achieved depends on the phase position of the correcting noise relative to the intake noise. The amount of the increase or reduction of the intake noise can be influenced by the amplitude of the correcting noise, and is limited by the loudspeaker output. The frequency of the correcting noise is directly dependent on the engine speed of the internal combustion engine.

The comparison of the actual noise with a desired reference noise can be advantageously utilized in various ways. For example, if the output of the loudspeaker is insufficient to cancel a strong intake noise, it can be transformed into a moderate intake noise tolerable in terms of human perception. In addition, the driver of the vehicle requires acoustic feedback from the engine at certain operating intervals. This is necessary, for example, to determine the correct point for changing gears. In these operating states, the intake noise of the internal combustion engine can be influenced directly, e.g., by a decreasing intake noise reduction in higher engine speed ranges. Finally, by specifying the reference noise, the intake noise can be influenced to achieve a sporty sound. This allows for application scenarios in the area of so-called sound design.

An apparatus for carrying out the method of the invention is also described hereinafter. This apparatus must comprise at least the following components:

A control system is necessary which can process the engine speed signal D of the internal combustion engine in order to generate a control signal A based on the engine speed. The control signal A is used to actuate the electromechanical converter, especially the loudspeaker used to generate the correcting noise. In addition, the control system must receive information about the reference noise signal S and the actual noise signal I. The reference noise signal is used by the control system for comparison with the actual noise signal, so that the variance can be determined. The actual noise signal is comprised of the superimposition of the correcting noise over the intake noise, as described earlier. The reference noise signal corresponds to a reference noise which is to be generated by influencing the intake noise with the correcting noise.

To generate the engine speed signal, the engine speed of the internal combustion engine must be supplied to the control system through an interface. An engine speed sensor, which can also be integrated into the engine management system, is generally connected to this interface. In most cases, this type of sensor already provides an engine speed signal, which may have to be converted into the engine speed signal D.

A sensor must also be provided to sense or register the actual noise. This sensor then provides a corresponding actual noise signal I, which can be processed in the control system.

Finally, an electromechanical converter must be provided to generate the correcting noise. A commercially available loudspeaker is generally sufficient for this purpose.

The described device requires a minimal use of components to actively influence the intake noise. The control system preferably comprises a digital computer. Accordingly, the signals must be converted into analog or digital form. It may be necessary to amplify the control signal to achieve the desired amplitudes of loudspeaker vibrations needed to generate the correcting noise.

In accordance with one specific embodiment of the control system, the apparatus comprises the following components:

A first means is provided to generate the control signal, whose frequency is dependent on the engine speed signal D. This may, for example, be a generator for a sinusoidal control signal.

A second means is used to set the level and phase of the control signal A in dependence on a comparison signal V. The comparison signal V represents the outcome of the comparison between the actual noise signal I and the reference noise signal S. Therefore, it indicates the divergence of the actual noise from the desired reference noise. Based on this value, the level and phase of the control signal is corrected, resulting in further approximation of the actual noise to the reference noise. A supplementary means to account for the acoustic transfer function between the converter and the sensor can be useful in this process. This allows for the free choice of installation locations for the electromechanical converter and sensor. Thus, the transfer function is a constant parameter dependent on the system.

A third means is provided for generating the reference noise signal S. This means can also be integrated into the control system's computer. The minimum input variable processed by the computer is the engine speed signal D, which can be used to generate a reference noise signal S which is dependent on the engine speed. Of course, other engine parameters can be incorporated into this calculation, such as the position of the gas pedal, the selected gear in the transmission, or the throttle valve mentioned earlier.

A fourth means is provided to form a comparison signal from the actual noise signal and the reference noise signal. This is preferably achieved by forming the difference between the two signals, which permits conclusions to be drawn on the variance between the actual and reference noises. This results in the comparison signal V, which is used to influence the control signal A.

As mentioned earlier, it is especially advisable to execute the control signals in sinusoidal form. They can then be adjusted to conform to the higher orders of the engine speed-dependent engine noise. If several orders of the engine noise are to be influenced, the device must be cascaded. This means that the first and second means of the control system are arranged in multiple parallel arrays in the control system. Each parallel array is responsible for the generation of a special control signal A and/or for the adjustment of its level and phase. A fifth means then groups the control signals for addition, so that their superimposition on the third means can be passed on to generate the reference noise signal. This makes it possible to trigger the electromechanical converter.

BRIEF DESCRIPTION OF THE DRAWINGS

The invention will be described in further detail hereinafter with reference to illustrative preferred embodiments shown in the accompanying drawing figures in which.

DETAILED DESCRIPTION OF PREFERRED EMBODIMENTS

Figure 1:
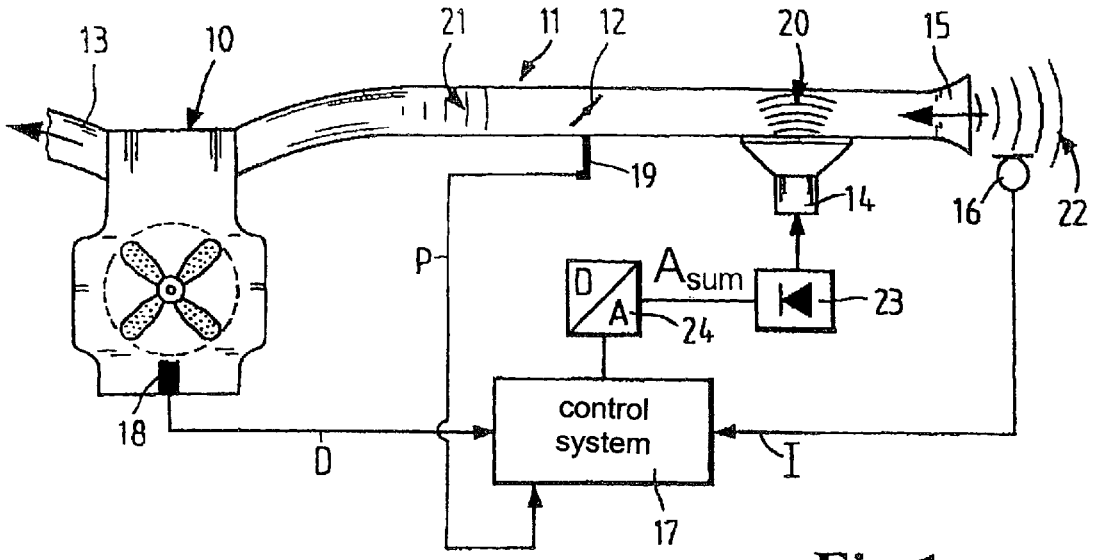
FIG. 1 shows the arrangement of the apparatus of the invention in an internal combustion engine as a modular mimetic display.

An internal combustion engine 10 is schematically illustrated in FIG. 1. It comprises an intake tract 11 with a throttle valve 12 and an exhaust system 13. The direction of flow of the intake air and of the exhaust is indicated by arrows.

An electromechanical converter 14, constructed here in the form of a loudspeaker, is also arranged in the intake tract. A sensor 16, constructed here as a microphone, is mounted on an air intake fitting 15. In addition, a control system 17 is provided to which an actual noise signal I registered by the sensor 16 and an engine speed signal D determined from the internal combustion engine 10 are supplied. The engine speed signal can be measured by an engine speed sensor 18, for example, or it can be derived from the engine control circuitry. An additional engine parameter, such as the throttle valve angle, may be measured, e.g., by using a position sensor 19. This measurement generates an additional parameter P, which can also be processed by the control system 17.

The control system 17 generates a control signal $A_{sum}$, which is converted by the electromechanical converter 14 into a correcting noise 20. This noise is superimposed on the intake noise 21 of the internal combustion engine, which is broadcast by the intake tract 11. This results in an actual noise 22 which can be measured by the sensor 16 at the intake fitting 15, for example, thereby obtaining the actual noise signal I.

The control system 17 may comprise a digital computer. If so, the digital control signal $A_{sum}$ must be converted by a digital analog converter 24 into an analog signal, which can be used to actuate the electromechanical converter 14. This embodiment represents the most effective option with respect to component complexity, production costs, and reliability of the device. However, it is also conceivable to construct the control system 17 as an analog computer. The signals are then processed in analog fashion and, if necessary, may require prior conversion into analog signals (depending on whether the sensors supply digital or analog signals). Then the control signal $A_{sum}$, which provides an analog control system 17, no longer needs to be converted. It may be necessary to amplify the control signal $A_{sum}$. If so, this can be achieved with an amplifier.

Figure 2:
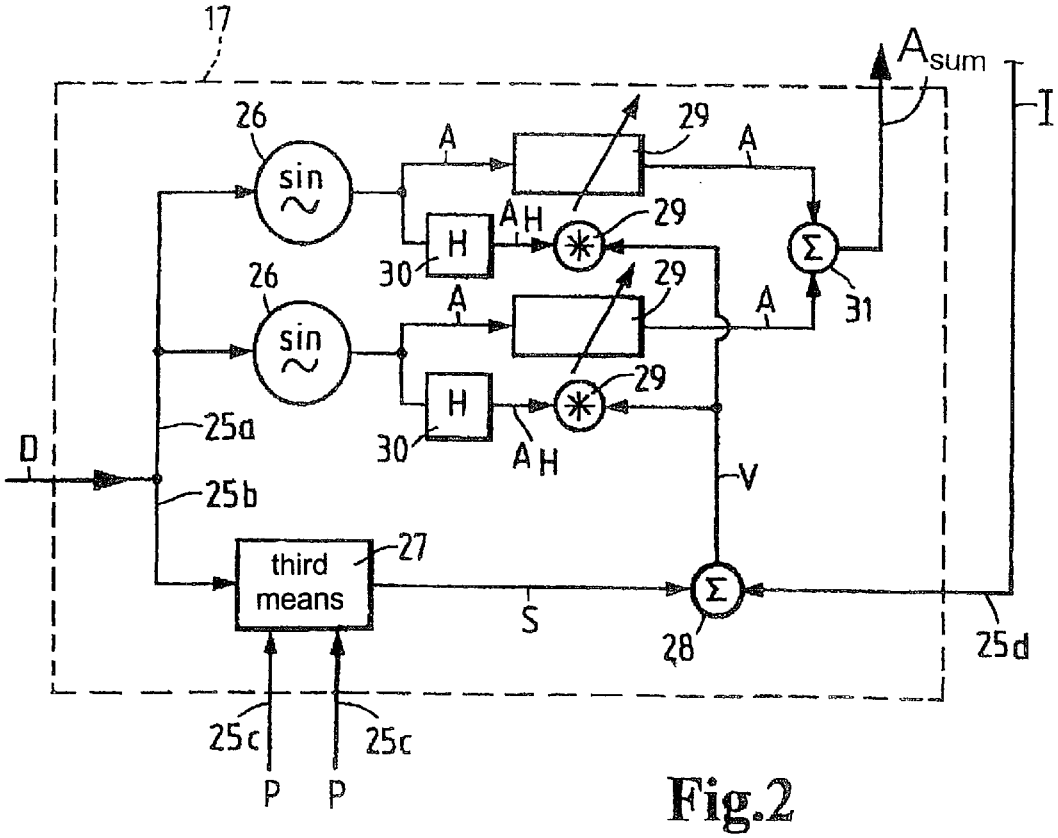
FIG. 2 shows a possible structure for the control system of FIG. 1 as a modular mimetic display.

An example of the structure of the control system 17 is provided in FIG. 2. This control system features an interface 25*a, b* for receiving the engine speed signal D from the internal combustion engine. Through the interface 25*a*, the engine speed signal D can be processed by a first means 26 to generate an engine speed-dependent control signal A.

Through the interface 25*b*, a third means 27 is also supplied with the control system signal D. Additional parameters, such as information about the position of the throttle valve 12, the position of the gas pedal, the engaged gear or the amount of air being supplied to the internal combustion engine can be fed into the third means 27 through the interfaces 25*c*.

A fourth means 28 is provided to generate a comparison signal V. The comparison signal is calculated by determining the difference between the reference noise signal S and the actual noise signal I, which is supplied to the control system through an interface 25*d*.

The first means, which was mentioned earlier, generates the control signal A. The engine speed signal D of the internal combustion engine is already used in generating this control signal. In the control system of the prototype, the first means 26 is provided in duplicate. This allows for two orders of the engine speed-dependent intake noise to be influenced directly. In the manner described, the system can be cascaded for any number of orders.

The first means is followed by a second means 29 for setting the level and phase of the control signal A. To this end, the comparison signal V is used, which represents a measure of the divergence of the actual noise 22 from a reference noise corresponding to the reference noise signal S. The comparison signal V is multiplied by control signal $A_H$ controlled by the transfer function H, resulting in a measure for modifying the level and phase of the control signal A. The transfer function H results from the geometric and acoustic circumstances of the application case, and can be a constant. It results from the fact that the intake noise 21 onto which the correcting noise 20 has been superimposed is subject to a modification described by the transfer function H until it has been recorded by the sensor 16 as an actual noise 22. The transfer function H is filed in an additional means 30 and is made available to the second means 29.

Each of the second means 29 delivers a control signal A which is defined in terms of frequency, amplitude and phase position. These control signals area added together by a fifth means 31, and in this way provide a control signal $A_{sum}$, which is supplied to the electromechanical converter. Consequently, the fifth means 31 is only necessary when there is cascading of multiple motor orders. However, this does not affect the basic structure of the device. In each case, the control system delivers a control signal A or $A_{sum}$, the purpose of which is to control the electromechanical converter.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. An apparatus for actively influencing intake noise of an internal combustion engine by generating a correcting noise and superimposing the correcting noise on an intake noise produced by the engine, said apparatus comprising:

a control system for processing an engine speed signal D, at least one further engine parameter P, a reference noise signal S and an actual noise signal I to generate a control signal A, an engine speed signal source connected to the control system for providing said engine speed signal D, a noise sensor connected to said control system for sensing an actual noise and for producing said actual noise signal I, and an electromechanical converter connected to an output of said control system for receiving said control signal A and generating the correcting noise to be superimposed on the intake noise in dependence on said control signal A, wherein the control system comprises:

means for generating the control signal A with a frequency dependent on the engine speed signal D, means for comparing the actual noise signal I and the reference noise signal S and generating a comparison signal V, and means for adjusting the level and phase of the control signal A in dependence on a comparison signal V.

2. An apparatus according to claim 1, wherein the means for adjusting the level and phase of the control signal A comprises a supplementary means for compensating for an acoustic transfer function H between the electromechanical converter and the noise sensor.

3. An apparatus according to claim 1, wherein the means for generating the control signal A is a sinusoidal signal generator.

4. An apparatus according to claim 1, wherein the control system comprises means for generating the reference noise signal in dependence on the engine speed signal D and the at least one further engine parameter P.

5. An apparatus according to claim 4, wherein said control system comprises plural means arranged in parallel for generating control signals and for adjusting the control signals in response to the comparison signal and a summing device for summing the control signals from the plural control signal generating and adjusting means and transmitting the summed control signal to the reference signal generating means.

6. An apparatus according to claim 1, wherein said at least one further engine parameter P comprises a throttle valve position of the internal combustion engine.

7. An apparatus according to claim 1, wherein said engine speed signal source is engine speed sensor which detects the engine speed of the internal combustion engine.

* * * * *